US005525083A

United States Patent [19]

Reich

[11] Patent Number: 5,525,083

[45] Date of Patent: Jun. 11, 1996

[54] TOWABLE WATER SPORTS APPARATUS SUCH AS A WATER SKI

[75] Inventor: Robert Reich, Redmond, Wash.

[73] Assignee: O'Brien International, Inc., Redmond, Wash.

[21] Appl. No.: 289,017

[22] Filed: Aug. 11, 1994

[51] Int. Cl.[6] ..... B63B 1/00

[52] U.S. Cl. ..... 441/68

[58] Field of Search ..... 441/68–70, 65, 441/79, 74, 39.2; D21/229, 230; 280/602

[56] References Cited

U.S. PATENT DOCUMENTS

| | | | |
|---|---|---|---|
| Re. 27,235 | 11/1971 | Pope, Jr. | 441/68 |
| 3,015,831 | 1/1962 | Franke | D21/229 |
| 3,027,575 | 4/1962 | Fortin | 441/68 |
| 3,040,345 | 6/1962 | Green et al. | 441/68 |
| 3,428,979 | 2/1969 | Johnson | 441/68 |
| 3,827,096 | 8/1974 | Brownson | 441/68 |
| 4,592,567 | 6/1986 | Sartor | 280/602 |
| 4,608,023 | 8/1986 | Williams | 441/68 |
| 4,731,038 | 3/1988 | Hancock et al. | 441/68 |
| 4,795,386 | 1/1989 | LaPoint | 441/68 |
| 4,863,408 | 9/1989 | Lewis | 441/70 |
| 5,030,151 | 7/1991 | Beacham | 441/79 |
| 5,080,620 | 1/1992 | Reden | 441/68 |
| 5,213,535 | 5/1993 | Richens, Jr. | 441/68 |
| 5,284,357 | 2/1994 | Tinkler | 280/602 |

FOREIGN PATENT DOCUMENTS

| | | | |
|---|---|---|---|
| 1285471 | 1/1962 | France | 441/68 |

*Primary Examiner*—Edwin L. Swinehart

[57] ABSTRACT

A towable water sports apparatus such as a water ski is provided with a narrowed waist portion in the forward half of the ski, a concave tunnel in the bottom surface of the ski which terminates in a Y-shaped end adjacent the tail end of the ski, a flex-adjusting plate which is secured to the top surface of the ski, and a vibration dampening cell which is positioned in a recess in the core of the ski and which is covered by the cover of the ski.

13 Claims, 2 Drawing Sheets

TOWABLE WATER SPORTS APPARATUS SUCH AS A WATER SKI

BACKGROUND AND SUMMARY

This invention relates to a towable water sports apparatus such as a water ski, kneeboard, wakeboard, or waterski board. More particularly, the invention relates to a towable water sports apparatus which is provided with one or more features for improving the performance of the apparatus.

Water skis, kneeboards, wakeboards, water ski boards and the like are designed to be towed behind a motor boat. The user stands, kneels, or sits on the device, and a tow rope is held by the user or attached to the device. Such devices conventionally include an elongated body having top and bottom surfaces, a forward end, a tail end, and a pair of sides.

In accordance with one aspect of the invention, the body is provided with a narrowed waist portion in the forward half of the body. The waist portion is formed by inwardly concave portions of the sides. The waist portion permits better and more secure penetration of the body in the water before turns and better tracking during turns. The waist portion also reduces lift when pressure is exerted on the forward portion of the body.

In accordance with another aspect of the invention, a flex-adjusting plate(s) is secured to the top surface of the body for controlling flex and performance of the apparatus. The plate is provided with a pair of elongated slots so that the position of the plate can be varied as desired for affecting the turning and accelerating characteristics of the apparatus.

The bottom surface of the body may be provided with a concave tunnel which terminates in a generally Y-shaped end portion adjacent the tail end of the body. The Y-shaped end portion channels water flow in laterally outward directions and channels turbulence and air away from the tail of the apparatus where a fin may be located.

Another aspect of the invention includes a vibration dampening cell which is positioned in a recess in the body. The body is advantageously formed from a molded core and a cover, and the recess is provided in the core. The vibration dampening cell absorbs or dampens vibration or chatter of the core and reduces vibration which is transmitted to the user of the apparatus.

DESCRIPTION OF THE DRAWING

The invention will be explained in conjunction with illustrative embodiments shown in the accompanying drawing, in which.

DESCRIPTION OF SPECIFIC EMBODIMENTS

The invention will be explained in conjunction with a water ski. However, it will be understood that the invention can also be used with other towable water sports devices such as kneeboards, waterski boards, wakeboards, etc.

Figure 1:
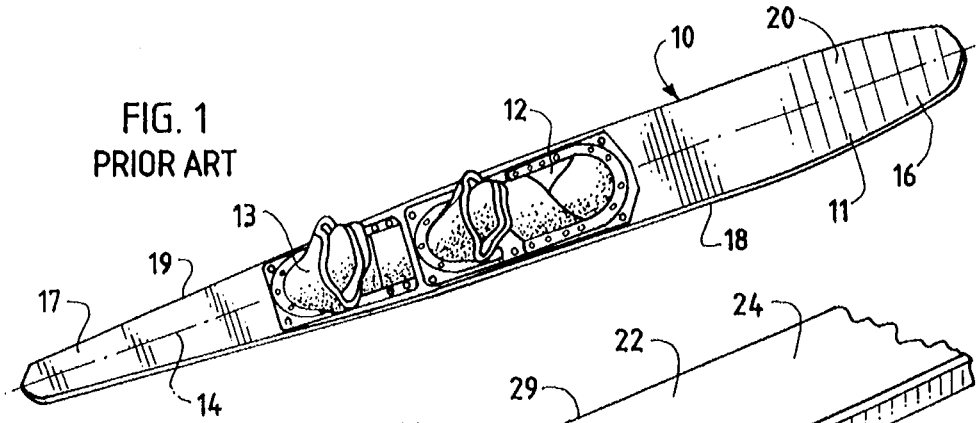
FIG. 1 PRIOR ART
FIG. 1 is a perspective view of a prior art slalom water ski.

FIG. 1 illustrates a prior art slalom water ski 10 which is described in U.S. Pat. No. 4,795,386. The slalom water ski includes an elongated ski body 11 and a pair of foot bindings 12 and 13 which are mounted on the ski body along the longitudinal centerline 14 of the ski body.

The ski body includes a forward end 16, a tail end 17, and a pair of sides 18 and 19. The ski also includes a top surface 20 and a bottom surface (not shown). As described in U.S. Pat. No. 4,795,386, the bottom surface includes a concave tunnel.

Figure 2:
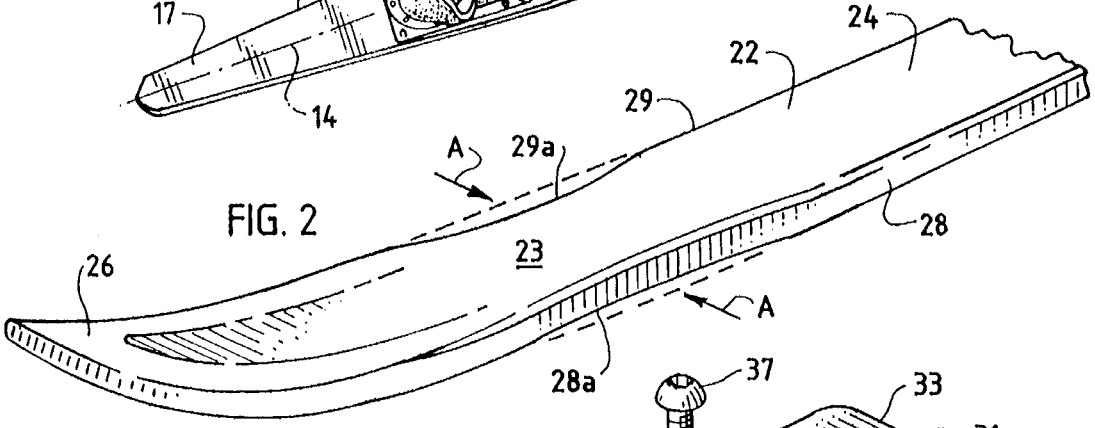
FIG. 2 is a fragmentary perspective view of a water ski which includes a waist portion in accordance with the invention.

FIG. 2 illustrates a water ski 22 which is similar to the water ski 10 with the exception of a waist portion 23 in the forward portion of the ski. The water ski 22 includes a top surface 24, a bottom surface 25 (FIG. 6), a forward end 26, a tail end 27 (FIG. 6), and a pair of sides 28 and 29. The sides 28 and 29 extend concavely inwardly in the direction of the arrows A at 28*a* and 29*a* to form the narrowed waist portion 23 which is narrower than the portions of the water ski both forwardly and rearwardly of the waist portion. The concave portions 28*a* and 29*a* are gradually curved in a generally C-shape, and the width of the ski just forwardly of the waist portion is substantially the same as the width of the ski just rearwardly of the waist portion.

The waist portion is located in the forward half of the ski, i.e., the portion of the ski which is forward of the longitudinal midpoint of the ski. The waist portion is preferably located forwardly of the foot binding on the ski.

Figure 3:
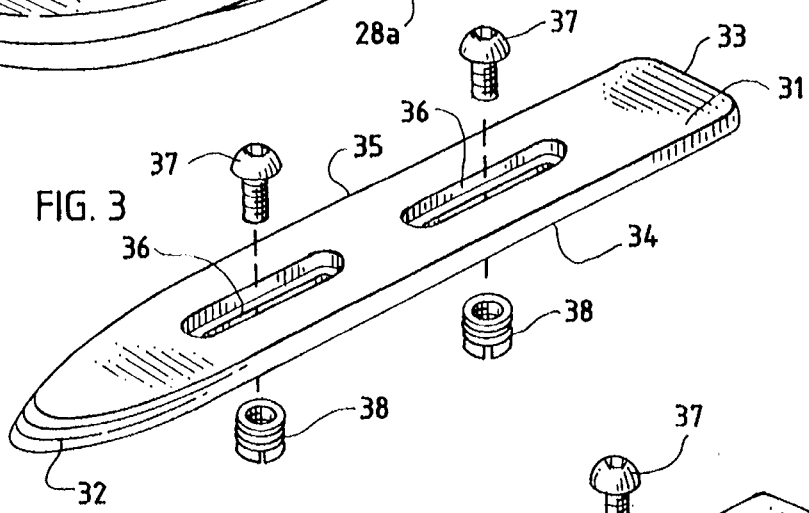
FIG. 3 is an exploded perspective view of a flex-adjusting plate and fasteners.

FIG. 3 illustrates a flex-adjusting plate 31 which can be secured to the water ski for controlling the stiffness or flexibility of the ski. The flex-adjusting plate 31 includes a tapered forward end 32, a rear end 33, and a pair of sides 34 and 35. A pair of elongated slots 36 are provided in the flex-adjusting plate for receiving threaded fasteners 37. The fasteners 37 secure the flex-adjusting plate to the ski by screwing into internally threaded cylindrical inserts 38 which are embedded in the body of the ski. The flex-adjusting plate is advantageously formed from aircraft-quality aluminum for high strength and durability.

Figure 4:
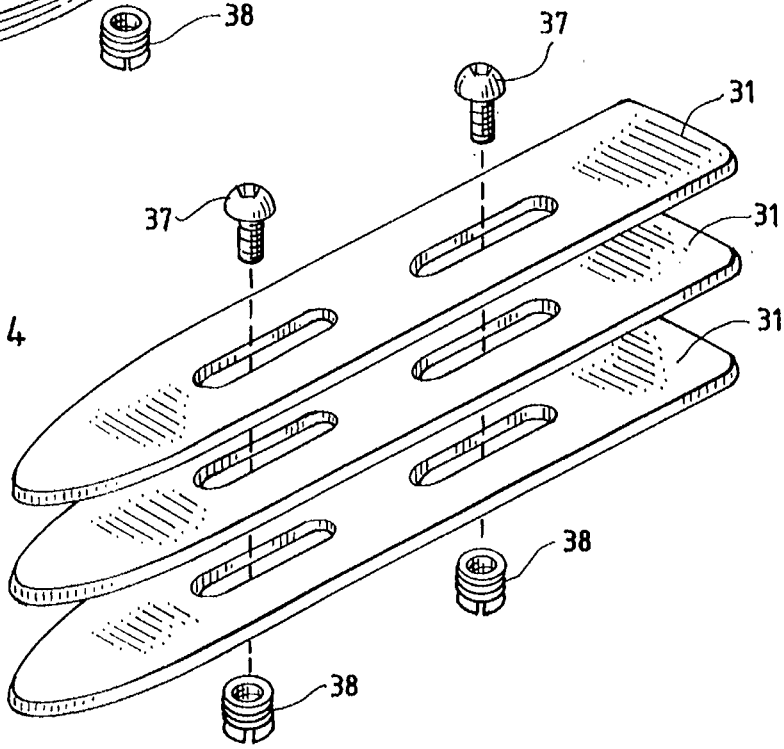
FIG. 4 is a view similar to FIG. 3 showing a plurality of flex-adjusting plates for increasing the stiffness a water sports apparatus.

FIG. 4 illustrates three flex-adjusting plates 31 which are superimposed on each other and secured by the fasteners 37. The additional flex-adjusting plates further increase the stiffness of the ski. More or fewer adjusting plates can be used as desired.

Figure 5:
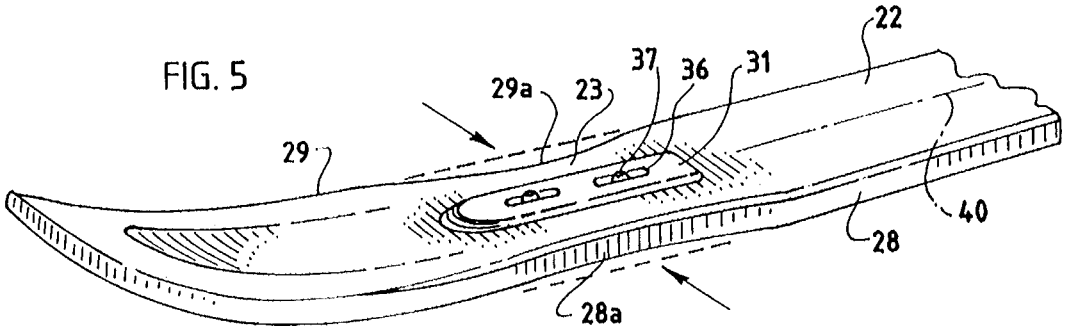
FIG. 5 is a fragmentary perspective view showing a flex-adjusting plate secured to a water ski.

FIG. 5 illustrates the flex-adjusting plate 31 secured to the top surface of the water ski 22 in the waist portion 23. The slots 36 of the plate are aligned with the longitudinal centerline 40 of the ski, and the slots permit adjustment of the longitudinal position of the plate.

If the water ski is formed with a waist portion 23, the flex-adjusting plate is preferably located in the waist portion. However, the flex-adjusting plate can be used on skis and other towable devices without a waist portion, or the flex-adjusting plate can be located in other portions of the ski.

Figure 6:
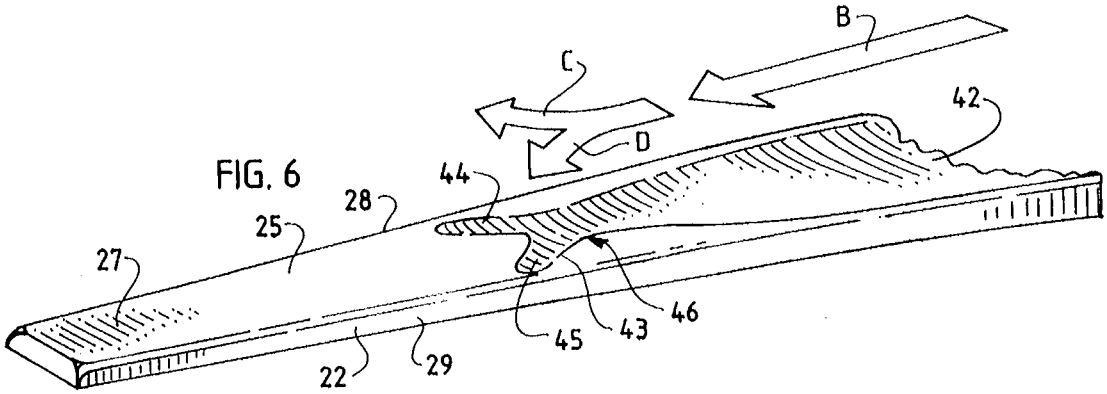
FIG. 6 is a bottom perspective view of a water ski illustrating the Y-shaped end portion of the concave tunnel.

FIG. 6 illustrates the bottom surface 25 of the water ski and the concave tunnel 42 which is formed therein. The concave tunnel 42 extends longitudinally along the bottom of the ski and terminates in a Y-shaped end portion 43. The Y-shaped end portion 43 includes a pair of diverging tunnel portions 44 and 45 which diverge rearwardly and outwardly toward the sides 28 and 29 of the ski. The tunnel portion 42 narrows to a waist portion 46 just forwardly of the Y-shaped end portion 43. With the exception of the waist portion 46 and the Y-shaped end portion 43, the tunnel 42 can be otherwise conventional.

The forward portion of the tunnel 42 channels water longitudinally in the direction of the arrow B. The diverting end portions 44 and 45 channel water outwardly away from the tail end in the directions of the arrows C and D. The end portions can extend at an angle of about 45° to the longitudinal centerline of the ski.

Figure 7:
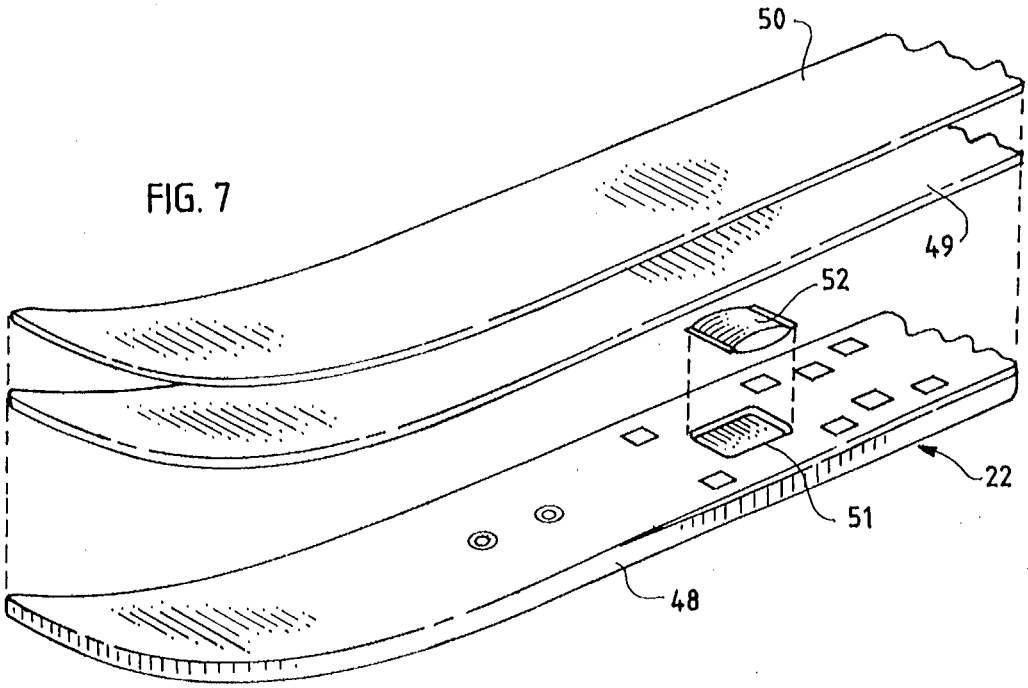
FIG. 7 is an exploded fragmentary perspective view illustrating a vibration dampening cell positioned in a recess in a core of a water ski below the cover of the water ski.

Referring now to FIG. 7, the water ski 22 includes a molded foam core 48 and a laminated cover for the core which comprises a layer 49 of fiberglass and resin and a top skin 50 of ABS plastic or aluminum. Such molded cores and laminted covers are conventional and well known.

The core 48 is provided with a recess or cavity 51 which is molded into the core, and a vibration dampening cell 52 is positioned in the recess before the cover is secured to the core. The vibration dampening cell is advantageously formed from a polyethylene bag which is filled with a viscous fluid. Preferably, the viscous fluid is biodegradable.

When the cover is secured to the core in the conventional manner, the vibration dampening cell contacts both the core and the cover. The volume of the cell relative to the volume of the recess is preferably such that the cell is pressed into firm engagement with both the core and the cover.

In a slalom ski the vibration dampening cell is advantageously located under the front foot binding. In a combo ski the cell can be located under the single foot binding. In other towable water sports devices, the cell can be located in the area where the user contacts the device.

If desired, additional dampening can be obtained by using more recesses and cells or by using a larger recess and a larger cell.

The various novel features which have been described herein can be used singly or in any combination desired. Each feature contributes independent advantages which can be realized without using other features. However, optimum performance is obtained when all of the features are used.

The narrowed waist portion 23 in the forebody of the ski allows for better and more secure pre-turn penetration of the ski in the water and better ski tracking during the turn. The waist portion also reduces lift when pressure is exerted on the forebody of the ski by the skier. The skier is therefore able to carve tight turns and penetrate rough water with extra holding power.

The sides 28 and 29 can be provided with sharp edges which allow the ski to set deeply and securely in the water during pre-turn, extension, and follow through. The result is a tigher, truer carve requiring much less body movement during the turning process and a stabilized ride throughout the course of skiing.

The flex-adjusting plate 31 controls the stiffness characteristics of the ski. The location of the plate can be shifted to change the areas of stiffness and flex for customized performance. Adding or deleting plates and/or changing the position of plates can dramatically affect the turning or accelerating characteristics of a water ski, kneeboard, wakeboard, etc.

Water skis and other towable products have inherent flexiblity. The flex-adjusting plate allows a user to control and adjust flexing and limit tip distortion and pre-turn dump by maintaining the designed forebody rocker and slope. It can also be used to control flex and distortion in other areas of water skis and other towable products.

The Y-shaped tail end portion 43 of the concave tunnel 42 improves on-the-water performance and maneuverability. The diverging end portions 44 and 45 serve as pressure release flutes which channel water flow in outward directions and allow the ski to sit more securely in the water.

A water ski conventionally includes a fin on the bottom surface adjacent the tail end of the ski. The diverging portions 44 and 45 of the tunnel channel turbulence and air away from the fin, allowing the ski to track in a clean water flow.

The pressure release flutes thereby hold the tail of the ski in the water and enhance stability and control at all speeds and in all conditions. The flutes also relieve pressure and drag in the tail during turns permitting the tail sweep to follow the curve of the forebody.

The vibration dampening cell 52 reduces tip chatter and vibration. Vibration is dampened or absorbed by the viscous fluid, providing a smoother, more controllable ride. The dampening cell is particularly effective in rough or choppy water.

While in the foregoing specification, a detailed description of a specific embodiment of the invention was set forth for the purpose of illustration, it will be understood that many of the details herein given may be varied considerably by those skilled in the art without departing from the spirit and scope of the invention.

I claim:

1. A water ski comprising an elongated ski body having top and bottom surfaces, a forward end, a tail end, and a pair of sides extending between the forward end and the tail end, the ski body having a forward portion between the longitudinal midpoint of the ski body and the forward end, said forward portion having a waist portion which is formed by inwardly concave portions of the sides, the waist portion being located forwardly of the longitudinal midpoint of the ski body.

2. The water ski of claim 1 including a foot binding mounted on the ski body, the waist portion being located forwardly of the foot binding and between the foot binding and the forward end.

3. The water ski of claim 1 in which the concave portion of each of the sides is generally C-shaped.

4. The water ski of claim 1 in which the width of the body forwardly and rearwardly of the waist portion is substantially the same.

5. The water ski of claim 1 including a flex-adjusting plate secured to the top surface of the body in the waist portion.

6. The water ski of claim 5 in which the flex-adjusting plate is provided with a pair of elongated slots, and a threaded fastener extending through each of the slots into the body whereby the longitudinal position of the flex-adjusting plate can be varied.

7. A towable water sports apparatus intended to be towed behind a power boat comprising an elongated flexible body having top and bottom surfaces, a forward end, a tail end, and a pair of sides extending between the forward end and the tail end, a binding mounted on the top surface of the flexible body, a flex-adjusting plate located forwardly of the binding, and securing means for adjustably securing the flex-adjusting plate to the top surface of the body for adjusting the flexibility of the body and for permitting the longitudinal position of the flex-adjusting plate to be varied.

8. A towable water sports apparatus intended to be towed behind a power boat comprising an elongated flexible body having top and bottom surfaces, a forward end, a tail end, and a pair of sides extending between the forward end and the tail end, a binding mounted on the top surface of the flexible body, a flex-adjusting plate located forwardly of the binding and secured to the top surface of the body for adjusting the flexibility of the body, the flex-adjusting plate being provided with a pair of elongated slots, and a threaded fastener extending through each of the slots into the body whereby the longitudinal position of the flex-adjusting plate can be varied.

9. The apparatus of claim 8 including a pair of internally threaded generally cylindrical inserts which are embedded in the body, the threaded fasteners being threadedly engaged with the inserts.

10. The apparatus of claim 7 in which the flex-adjusting plate is formed from metal.

11. The apparatus of claim 7 in which the flex-adjusting plate is formed from aluminum.

12. The apparatus of claim 7 in which the water sports apparatus is a water ski.

13. A towable water sports apparatus intended to be towed behind a power boat comprising an elongated flexible body having top and bottom surfaces, a forward end, a tail end, and a pair of sides extending between the forward end and the tail end, and a flex-adjusting plate secured to the top surface of the body for adjusting the flexibility of the body, and a second flex-adjusting plate superimposed on the first flex-adjusting plate and secured to the body.

* * * * *